US005083387A

United States Patent [19]

Tillotson et al.

[11] Patent Number: 5,083,387

[45] Date of Patent: Jan. 28, 1992

[54] REMOVABLE SNOWTHROWER CHUTE

[75] Inventors: Henry B. Tillotson, Minneapolis; James R. Baumann, St. Louis Park, both of Minn.

[73] Assignee: The Toro Company, Minneapolis, Minn.

[21] Appl. No.: 220,198

[22] Filed: Jul. 18, 1988

[51] Int. Cl.[5] ..... E01H 5/09

[52] U.S. Cl. ..... 37/260; 37/244; 292/209; 403/330

[58] Field of Search ..... 37/244, 245, 246, 257, 37/259, 260, 261; 403/335, 338, 330; 285/87, 88, 308, 319; 292/204, 209, 256.63

[56] References Cited

U.S. PATENT DOCUMENTS

| | | | |
|---|---|---|---|
| 2,536,166 | 1/1951 | Garland | 37/245 |
| 2,587,415 | 2/1952 | Vanvick | 37/257 |
| 4,104,812 | 8/1978 | Stribiak, Jr. | 37/243 |
| 4,184,274 | 1/1980 | Vohl | 37/261 |
| 4,312,143 | 1/1982 | Kado | 37/261 |
| 4,422,794 | 12/1983 | Deken | 403/330 |
| 4,441,345 | 4/1984 | Guarr | 292/209 X |
| 4,577,837 | 3/1986 | Berg et al. | 403/330 X |
| 4,683,731 | 8/1987 | Wickman et al. | 292/209 X |
| 4,752,150 | 6/1988 | Salice | 403/330 |

OTHER PUBLICATIONS

"Steel Snow Thrower", p. 826, Sears 1980 Spring-Summer Catalog.

"18 HP Garden Tractor with 6-Speed Transaxle Drive", pp. 822-823, Sears 1980 Spring-Summer Catalog.

*Primary Examiner*—Edgar S. Burr
*Assistant Examiner*—Moshe I. Cohen
*Attorney, Agent, or Firm*—R. Lawrence Buckley

[57] ABSTRACT

The invention is directed toward a removable chute assembly (33) for a snowthrower (10). Chute (33) is connected to housing (12) of snowthrower (10) by using a plurality of locking assemblies (52) and a detent assembly (50). Each locking assembly (52) includes a pivoting member (56) which can engage a flange (38) of chute assembly (33) to hold chute assembly (33) in locked engagement with housing (12). Each pivoting member (56) is held in locked position by a detent member (70) which can be manipulated by an ignition key (13) of snowthrower (10), and each pivoting member (56) can be pivoted away from flange (38) to allow for the chute assembly (33) to be removed from housing (12). Preferably, key (13) engages a switch (15) such that key (13) can only be removed from switch (15) when the snowthrower is turned off. Therefore, chute assembly (33) can only be removed when the snowthrower is not operating.

5 Claims, 3 Drawing Sheets

REMOVABLE SNOWTHROWER CHUTE

FIELD OF THE INVENTION

The subject invention relates generally to hand-operated snowthrowers, and more particularly to chutes for such snowthrowers.

BACKGROUND OF THE INVENTION

Hand-operated, or walk-behind, snowthrowers can be classified as either single stage or two stage devices, depending on the number of snow handling implements (e.g., impellers or fans). Thus, a single stage snowthrower includes a single rotating impeller whereas a two stage snowthrower typically includes a first auger stage and a second high speed fan stage, wherein the auger engages the snow and conveys it to the fan which throws the snow at high speed up and away from the snowthrower.

Although single stage snowthrowers are generally lighter, less expensive and intended for smaller tasks, both types of snowthrowers have common features. For example, each type of snowthrower typically includes a housing mounted on wheels or tracks for movement along the ground. The lower forward portion of the housing is open and contains one or both of the snow handling implements. Mounted to the housing and operatively coupled to the snow-handling implement(s) is a prime mover such as a gasoline engine or electric motor. Extending upwardly from the housing is a handle having an upper end located at a convenient height for the operator.

Single stage and two stage snowthrowers also include some type of adjustable snow deflecting device, e.g., a chute, deflector, or set of vanes, which selectively directs the thrown snow either forwardly or to one side or the other of the snowthrower. Typically the deflecting device, henceforth called the "chute" for convenience, is connected to the housing toward the top of the housing opening which contains the moving snow handling implement(s). As will be described further below, the present invention particularly concerns the chute and its interconnection with the snowthrower housing.

Recent attempts have been made to construct snowthrowers, particularly single stage snowthrowers, such that they can be rendered quite compact when not in use. There are several reasons for this trend, including the fact that snowthrowers are relatively expensive, and many consumers desire a portable machine which they can easily transport to various sites rather than one machine at each site. It is also desirable to have a snowthrower which can be easily folded or disassembled into a very compact state for storage purposes. From the manufacturers' standpoint, a machine which can be easily disassembled, folded, or generally made more compact is desirable since it can be shipped and stored in a smaller container and a single truck can carry more machines.

Prior art snowthrowers have certainly addressed the "compactibility" problem discussed above. In fact, many prior art snowthrowers include two-piece folding handles which have a lower handle portion connected to the housing and an upper portion pivotally connected thereto wherein wing nuts or thumb screws or the like are used to interconnect the two handle portions.

In addition, some very large snow excavating machines, not of the hand-operated or walk-behind type, have included folding or collapsible discharge chutes. See U.S. Pat. Nos. 4,312,143 and 4,184,274, for example. Such chutes are often provided so that the vehicle carrying the snowthrower unit can be garaged in normal fashion and can pass under low bridges. Although folding or collapsible chutes indeed render a snowthrower more compact or compactible, they also tend to greatly complicate the chute, add expense and weight to the snowthrower, and are generally inappropriate for use on small walk-behind snowthrowers.

Some prior art walk-behind snowthrowers have even included removable chutes, although not for the sake of compactibility. For example, reference is made to U.S. Pat. No. 2,536,166 which shows a chute which can be removed and reconnected to the housing to allow for adjustment of the chute relative to the housing. While at first glance this type of design might seem to adequately address the compactibility problem discussed above, it in fact is inadequate because it allows the chute to be easily removed without tools, thus posing a potential safety hazard. Such removable chutes also do not meet the currently-applicable ANSI standard B71.3-1984, Section 5.2, which indicates that all guards, shields, guides, and deflectors should be designed so that they cannot be removed from the machine without tools. Although it is not necessary that snowthrowers meet this ANSI standard, it is thought to be generally desirable.

The present invention addresses the snowthrower compactibility problem discussed above, and in particular is directed toward a removable snowthrower chute which complies with the aforementioned ANSI standard and which does not present a hazard of any type.

SUMMARY OF THE INVENTION

Accordingly, one embodiment of the present invention is a snowthrower which includes a housing; a discharge chute; a prime mover mounted to the housing; a switch operatively connected to the prime mover, the switch having an off state wherein the prime mover is disabled and an on state wherein the prime mover is enabled; a key which can engage the switch and reversibly move the switch between its on and off states, wherein when the switch is in its off state the key can be removed and when the switch is in its on state the key cannot be removed; and means for locking the chute to the housing, wherein the locking means can be selectively unlocked by the key, whereby the chute can be removed from the housing only when the switch is in its off state.

Another embodiment of the invention is a snowthrower which includes a housing; a discharge chute; and means for selectively locking the chute to the housing, wherein the locking means comprises: (i) a member pivotally connected to the housing proximate the chute; and (ii) a detent element operatively connected to the housing; wherein the detent element engages the pivoting member to hold the pivoting member in operative contact with the chute; and wherein the pivoting member forms a slot whereby the detent element can be accessed and manipulated to allow the pivoting member to swing away from the chute to unlock the chute from the housing.

DETAILED DESCRIPTION OF PREFERRED EMBODIMENT

Figure 1:
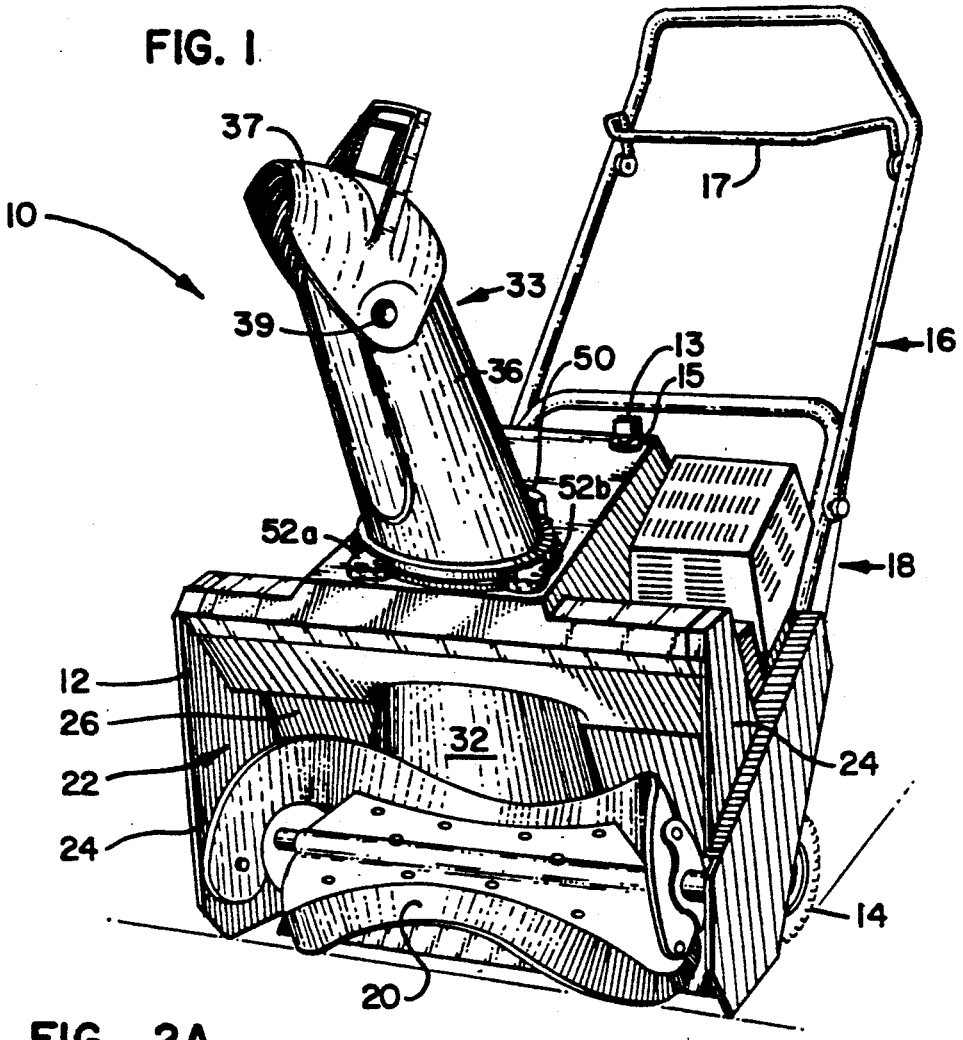
FIG. 1 is a perspective view of a preferred snowthrower according to the invention.
Figure 2A:
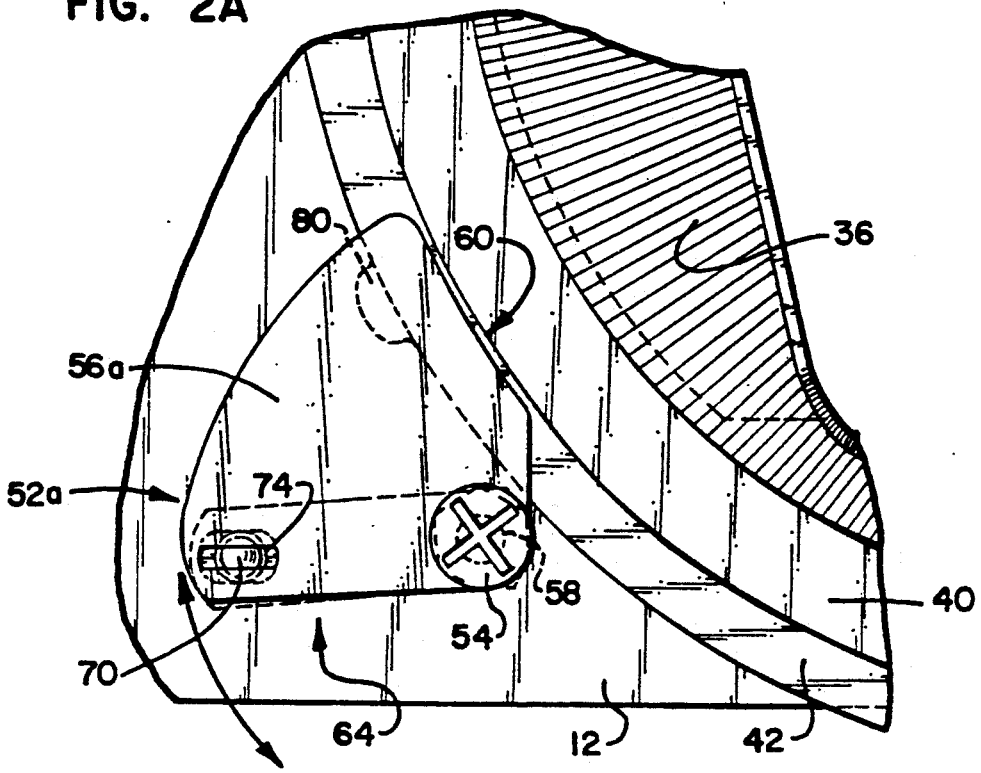
FIG. 2A is a top plan view of one of the chute locking assemblies of the snowthrower of FIG. 1.
Figure 2B:
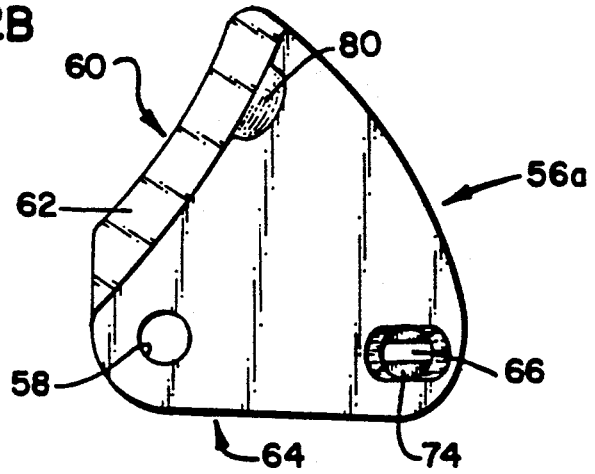
FIG. 2B is a bottom plan view of the pivoting member of the locking assembly of FIG. 2A.

A preferred embodiment of the invention will now be described with reference to the Drawing, wherein like reference numerals designate like parts and assemblies throughout the several views.

FIG. 1 shows a preferred snowthrower 10 according to the invention. Generally, snowthrower 10 includes a housing 12 supported for rolling along the ground by two spaced apart wheels 14. A U-shaped, upwardly extending handle assembly 16 is secured to the back of housing 12 and terminates at a height above the ground which is convenient for being gripped by an operator. An internal combustion engine 18, or any other suitable prime mover, is mounted a top and behind housing 12 and the output shaft (not shown) of engine 18 is rotatably coupled by belts and pulleys, or any other drive train means, to an impeller 20. A key 13 suitable for engagement with an ignition switch 15 selectively energizes engine 18, and key 13 preferably connects to ignition switch 15 in such a manner that in the off position it can be removed from switch 15 but in the on position it cannot be removed. Handle assembly 16 carries a pivoting bail 17 which selectively clutches prime mover 18 to impeller 20.

Housing 12 includes an open front portion 22 in which impeller 20 is housed for contacting the snow. Front portion 22 includes two side walls 24 and a rear wall 26. Rear wall 26 includes a lower arcuate portion (not shown) which is semicylindrical in shape and an upper substantially planar portion integrally connected thereto. Front portion 22 of housing 12 also preferably includes an inverted, funnel-shaped collecting chamber 32 located at the middle of the upper portion of rear wall 26, through which the snow picked up by impeller 20 is thrown upwardly and into a chute assembly 33 which adjustably directs or deflects the snow forwardly or laterally away from the snowthrower. The invention primarily pertains to chute assembly 33 and the manner in which chute assembly 33 connects to housing 12, and the remaining description will therefore focus on same.

Figure 4A:
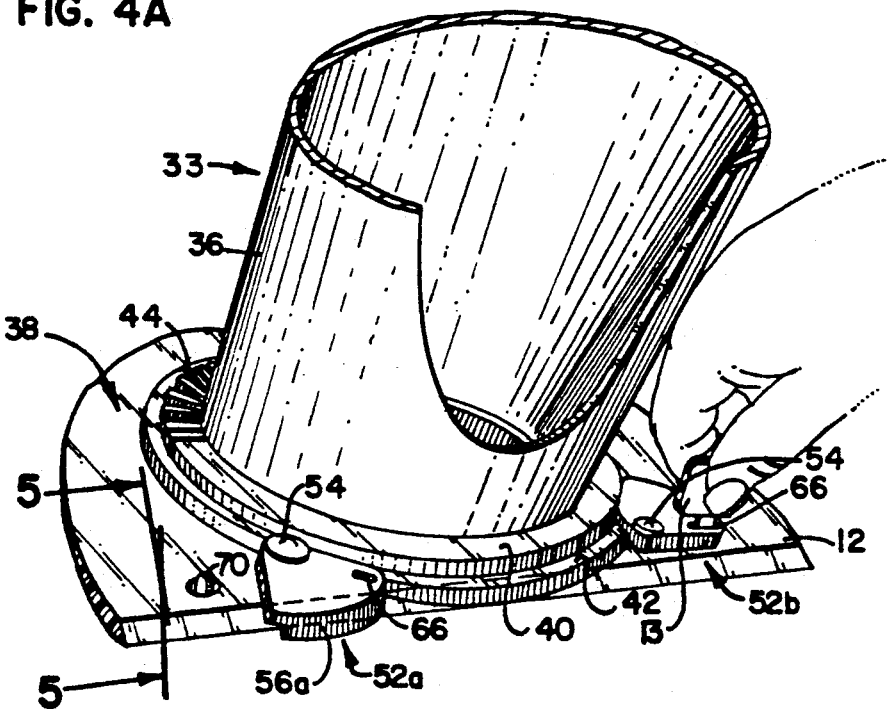
FIG. 4A is a perspective view of a portion of the snowthrower of FIG. 1, illustrating unlocking the locking assemblies to enable the removal of the chute.

Referring to FIGS. 1 and 4A, chute assembly 33 preferably includes an elongate tubular extension 36 which converges somewhat toward the top to produce a compact, high velocity snow stream. A portion of extension 36 forms an elongate opening for allowing the egress of snow. Attached to the bottom of extension 36 is an outwardly directed circular flange 38 which includes an inner somewhat thick shelf 40 having an outer diameter of about 6.75 inches and an inner diameter of about 6 inches; and an outer somewhat thin shelf 42 having a preferred outer diameter of about 7.25 inches. The nominal thickness of inner shelf 40 is preferably about 0.4 inch, and the thickness of outer shelf 42 is preferably about 0.2 inch. The upper surface of inner shelf 40 is smooth over its front half but forms ridges 44 over its rear half, ridges 44 being in the nature of gear teeth on the rack of a rack and pinion mechanism. The upper surface of outer shelf 42 is, by contrast, smooth around its entire periphery.

Pivotally mounted to the top of extension 36 is a deflector 37. A pair of connectors 39, one of which is shown in FIG. 1, connects chute portions 36 and 37 together.

Extension 36 is in fluid communication with collecting chamber 32, a substantially circular opening in the top of housing 12 allowing snow to pass from chamber 32 to chute assembly 33. Chute assembly 33 is removably mounted to the top of housing 12 at three places, spaced roughly 120° apart. One connection point, located toward the rear of the chute, can be a simple detent assembly 50 (see FIG. 4B) including a spring loaded ball or the like (not shown) which engages ridges 44 in inner shelf 40 of chute flange 38. Detent assembly 50 allows chute 33 to be incrementally rotated to adjust for forward or side-to-side snowthrowing as desired.

Spaced about 120° in either direction from detent assembly 50 is a locking assembly 52. Enlarged views of locking assemblies 52 are shown in FIGS. 2-5. The left locking assembly, when facing snowthrower 10, is designated with reference number 52*a*; the other is labelled 52*b*. Locking assemblies 52*a* and 52*b* are mirror images of one another, and therefore a description of only assembly 52*a* will suffice.

An important component of locking assembly 52*a* is a pie-shaped pivoting member 56*a*. Pivoting member 56*a* is pivotally connected to the top of housing 12 by, for example, a machine screw 54 which passes through an aperture 58 in one corner of pivoting member 56*a*. See FIG. 2B, which is a bottom plan view of pivoting member 56*a*. The inner edge 60 of pivoting member 56*a* forms an inverted L-shaped slot or ledge 62 which bears on the top (horizontal) surface and outer (vertical) edge of outer shelf 42 of chute flange 38 when locking assembly 52*a* is in its locked position, shown in FIG. 2A. Toward the opposite edge 64 of pivoting member 56*a* is a through slot 66, the purpose of which will be described further below.

Housing 12 is apertured to receive a spring loaded detent ball or plug 70. Although alternative designs are certainly contemplated, plug 70 is preferably mounted on a spring steel strap 72 fixedly attached to the underside of housing 12 by the same machine screw 54 which pivotally secures pivoting member 56. Detent plug 70 is received by a hemispherical detent recess 74 formed in the underside of pivoting member 56, wherein recess 74 is vertically aligned with slot 66 in pivoting member 56. Pivoting member 56 is removably held in its locked position by the interaction of detent plug 70 and recess 74. When it is desirable to remove chute assembly 33 from housing 12, it is simply necessary to (i) insert key 13 into slot 66 and push downward, thereby moving detent ball 70 out of ball recess 74, and (ii) twist key 13 in the appropriate direction to pivot member 56 away from flange 38 of chute assembly 33. When both locking assemblies 52 have been unlocked in this manner, flange 38 of chute assembly 33 can be slid out from under detent assembly 50 and away from housing 12. Preferably, slot 66 is configured to accept key 13 (see FIG. 3B) but reject screwdrivers, nails, etc., so as to effectively preclude removal of chute assembly 33 unless key 13 is indeed used.

Figure 3A:
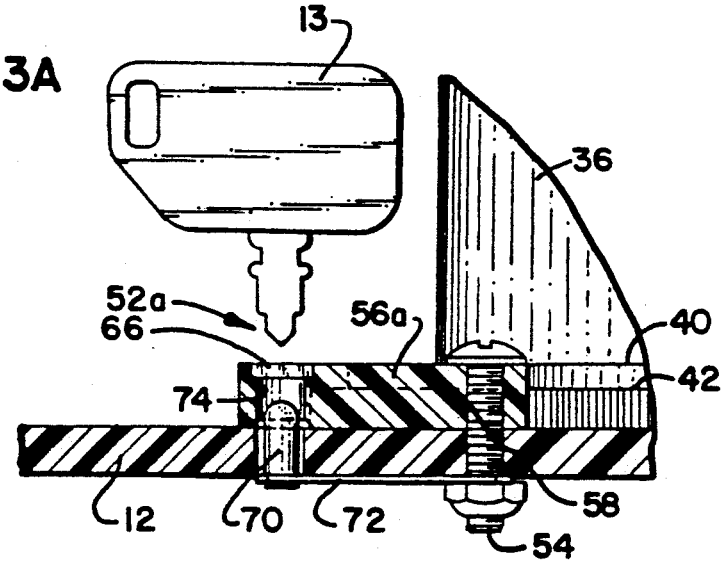
FIG. 3A is a sectional view of the locking assembly of FIG. 2A, taken generally along line 3—3 of FIG. 2A, with the key disengaged therefrom.
Figure 3B:
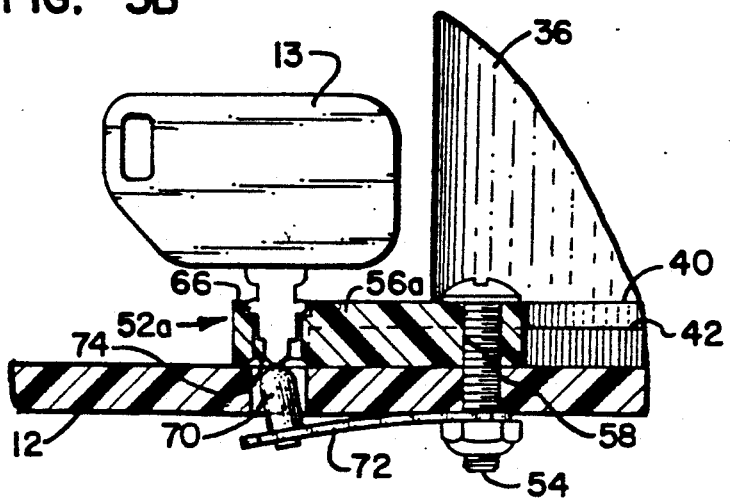
FIG. 3B is a sectional view in the nature of FIG. 3A, wherein the key is engaged.
Figure 5:
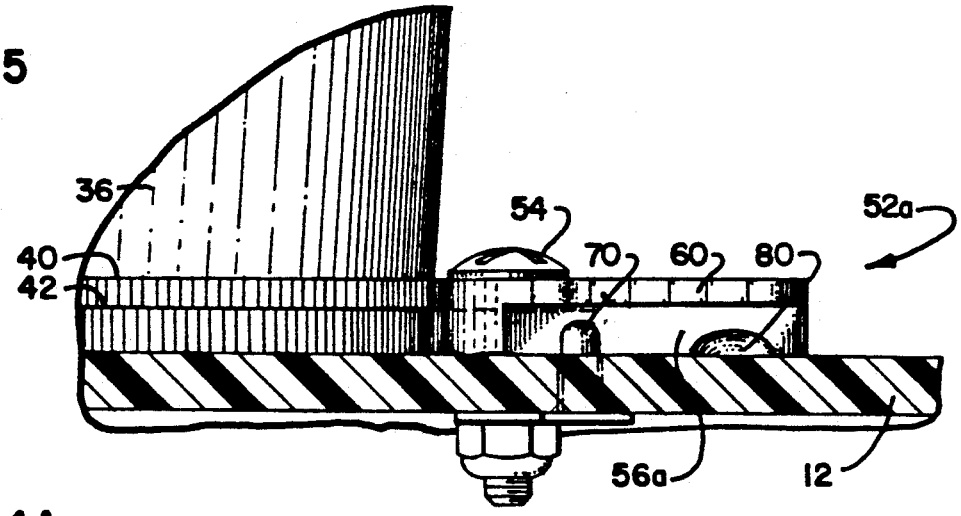
FIG. 5 is a sectional view of the snowthrower taken generally along line 5—5 of FIG. 4A, showing the inner edge of one of the pivoting members in elevation.

Thus, prior to using snowthrower 10 to in fact throw snow, chute assembly 33 is secured to housing 12 by positioning chute 33 such that flange 38 resides beneath detent assembly 50 and adjacent (unlocked) locking assemblies 52. Chute 33 is locked in that position by rotating members 56 such that their inner edges 60 come into contact with chute flange 38. Pivoting member **56*a* is rotated clockwise and member 56*b* is rotated counterclockwise to move them toward their locked positions. Inclined ramps 80 on the leading edges 60 of members 56 engage plugs 70 and force them downward into their retracted positions (as shown in FIG. 3B). Once members 56 have been fully rotated toward their locked positions, detent balls 70 snap into ball recesses 74 to hold members 56 in their locked positions. Plugs 70 and recesses 74 have substantially vertical mating surfaces, so it is necessary to retract plugs 70 from recesses 74 prior to rotating members 56 toward their unlocked positions. It should be noted that it is not necessary to use key 13 to rotate members 56 from their unlocked to their locked positions (because of ramps 80 interacting with plugs 70), but key 13 is necessary to engage detent plugs 70 to unlock members 56 and twist them from their locked positions (like assembly 52*b* in FIG. 4A) to their unlocked positions (like assembly 52*a* in FIG. 4A). Once assemblies 52 are returned to their locked states, key 13 can be inserted into ignition switch 15 and manipulated to activate or energize prime mover 18**.

Following the snowthrowing operation, if it is desirable to store or transport machine 10 in a very compact state, it is simply necessary to turn off the ignition by moving key 13 to its off position; removing key 13 from switch 15; inserting key 13 into slots 66 in members 56, thereby depressing detent plugs 70; pivoting members 56 out of their locked to their unlocked positions; manipulating chute assembly 33 such that flange 38 is drawn out from under detent assembly 50; and removing chute assembly 33 from housing 12. Of course, handle 16 can also be folded to increase the compactness of the unit.

Figure 4B:
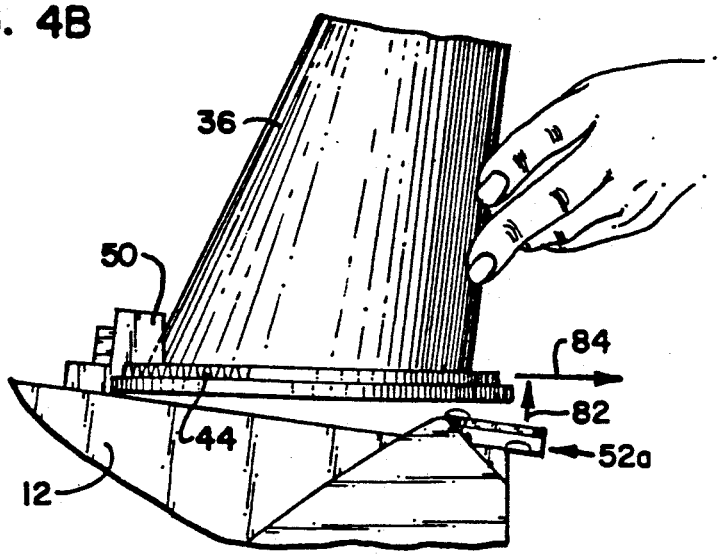
FIG. 4B is a side elevational view of the chute being tipped to clear the locking assemblies.

Importantly, both assemblies 52 must be unlocked to allow chute assembly 33 to be tipped and removed. In order to remove chute assembly 33, it must be tipped backward slightly, as shown in FIG. 4B, to allow the front edge of flange 38 to clear locking assemblies 52. Arrow 82 indicates the appropriate tipping direction. Once tipped, chute assembly can be drawn forward (see arrow 84) so that ridges 44 can slide out from under the detent ball (not shown) within detent assembly 50.

Also, it should be emphasized that key 13 can take on any shape or configuration. Locking assemblies 52 could be designed to accept any sort of key or tool, and the invention is not limited to use of the ignition or prime mover energization key. However, for the sake of safety the embodiment shown and described herein is thought to be preferable.

It should be noted that key 13 needn't necessarily operate an ignition switch 15 on a gasoline-engine-powered snowthrower. For example, key 13 could energize or enable an electric snowthrower, or could simply unlock or enable an ignition switch or the like. It is important that key 13 not be removable from the switch unless the snowthrower, or at least the impeller, is not operational, since the key can remove the chute.

There are other modifications which will be apparent to those skilled in the art. Accordingly, the scope of this invention will be limited only by the appended claims.

We claim:

1. A snowthrower comprising:

(a) a housing;

(b) a discharge chute having a flange at its base;

(c) means for selectively locking the chute to the housing, wherein the locking means comprises:

(i) a plurality of members pivotally connected to the housing proximate the chute, said members each having an aperture therethrough remote from their pivotal connection, said members being movable between a first position in which an edge of said members overlies a portion of said flange, and a second position in which said members do not overlie any portion of said flange; and (ii) a plurality of detent elements operatively connected to the housing, one of said detent elements being associated with each of said members, said detent elements being located on one side of said members and resiliently biased toward said members and being located to project into said apertures when said members are in said first positions, each of said detent elements being the sole means preventing pivotal movement of its associated said member from said first position to said second position, and means insertable into each of said apertures from the side of its associated member opposite the side on which said detent element is located to move said detent element out of said aperture against said resilient bias to permit said members to be pivoted to said second position and thereby free said discharge chute from said snowthrower.

2. The snowthrower of claim 1 wherein:

(a) the snowthrower further comprises a prime mover attached to the housing and a key suitable for activating the prime mover; and (b) the slot in the pivoting member can receive the prime mover key such that the detent element can be manipulated by the key and the pivoting member pivoted by the key to unlock the chute from the housing.

3. A snowthrower comprising:

(a) a housing;

(b) a discharge chute;

(c) a prime mover mounted to the housing;

(d) a switch operatively connected to the prime mover, the switch having an off state wherein the prime mover is disabled and an on state wherein the prime mover is enabled;

(e) a key which can engage the switch and reversibly move the switch between its on and off states, wherein when the switch is in its off state the key can be removed from the switch and when the switch is in its on state the key cannot be removed from the switch; and (f) means for locking the chute to the housing, wherein when the switch is in its off state the key can be removed therefrom and used to unlock the chute locking means, whereby the chute can be readily removed from the housing when the switch is in its off state, wherein the chute locking means comprises a plurality of locking assemblies, wherein each locking assembly comprises:

(i) a member pivotally connected to the housing proximate the chute; and (ii) a detent element operatively connected to the housing; wherein the detent element engages the pivoting member to releasably hold the pivoting member in operative contact with the chute whereby the chute is locked to the housing; and wherein the pivoting member forms a slot whereby the detent element can be accessed and manipulated to allow the pivoting member to swing away from the chute to unlock the chute from the housing.

4. A snowthrower comprising:

A. a housing;

B. a discharge chute comprising a flange and a tubular portion extending upwardly therefrom;

C. a prime mover mounted to the housing;

D. a switch operatively connected to the prime mover, the switch having an off state wherein the prime mover is disabled and an on state wherein the prime mover is enabled;

E. a key which can engage the switch and reversibly move the switch between its on and off states, wherein when the switch is in its off state the key can be removed from the switch and when the switch is in its on state the key cannot be removed from the switch; and F. chute locking means comprising a detent assembly and a pair of locking assemblies operatively engaging the chute flange to lock the chute to the housing, wherein each locking assembly comprises:

(1) a member pivotally connected to the housing proximate the chute; and (2) a detent element operatively connected to the housing, wherein:

a. the detent element engages the pivoting member to releasably hold the pivoting member in operative contact with the chute flange whereby the chute is locked to the housing; and b. the pivoting member forms a slot whereby the detent element can be accessed and manipulated by the key to allow the pivoting member to swing away from the chute flange to unlock the chute from the housing, wherein when the switch is in its off state the key can be removed therefrom and used to unlock the chute locking means, whereby the chute can be readily removed from the housing when the switch is in its off state.

5. The snowthrower of claim 4 wherein the detent assembly and the locking assemblies are substantially equally spaced about the flange of the chute.

* * * * *